United States Patent [19]

Cherry

[11] Patent Number: 4,614,298

[45] Date of Patent: Sep. 30, 1986

[54] OCTAGONAL BULK BIN

[75] Inventor: James H. Cherry, Marion, Iowa

[73] Assignee: Weyerhaeuser Company, Tacoma, Wash.

[21] Appl. No.: 705,414

[22] Filed: Feb. 26, 1985

Related U.S. Application Data

[63] Continuation of Ser. No. 485,514, Jan. 17, 1983, abandoned, which is a continuation of Ser. No. 255,583, Apr. 20, 1981, abandoned.

[51] Int. Cl.[4] ..... B65D 5/10

[52] U.S. Cl. ..... 229/109; 229/157

[58] Field of Search ..... 229/39 R, 41 C, 41 D, 229/38

[56] References Cited

U.S. PATENT DOCUMENTS

| | | | |
|---|---|---|---|
| 4,119,266 | 10/1978 | Dempster | 229/39 R |
| 4,279,377 | 7/1981 | Peeples | 229/39 R |
| 4,279,379 | 7/1981 | Lohrbach et al. | 229/39 R |
| 4,386,729 | 6/1983 | Schmidt | 229/41 C X |

FOREIGN PATENT DOCUMENTS

| | | | |
|---|---|---|---|
| 218420 | 11/1961 | Austria | 229/39 R |
| 452442 | 10/1949 | Italy | 229/39 R |

*Primary Examiner*—Joseph Man-Fu Moy
*Assistant Examiner*—Gary E. Elkins

[57] ABSTRACT

An octagonal container closure in which the bottom closure flaps are held in place while the structural integrity of the flaps is maintained. Locking apertures are placed in opposed side closure flaps. The apertures remove as little material as possible from the side closure flaps and maintain the rectangular shape of the flaps. The apertures are shaped and located to allow the corners of the opposed end closure flaps to protrude through the apertures and to lock behind the side closure flaps. The shape of the apertures provides a two-way lock on each corner of an end closure flap, holding it both in the length and width direction. This provides a firmer closure than has been previously achieved.

8 Claims, 7 Drawing Figures

Fig. 3
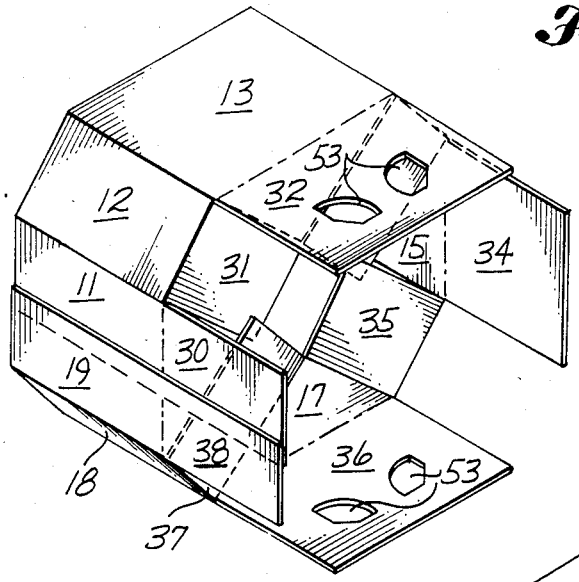
Fig. 4
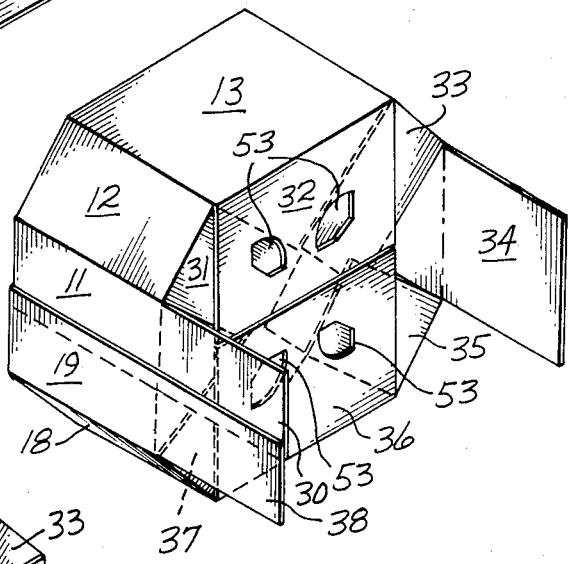
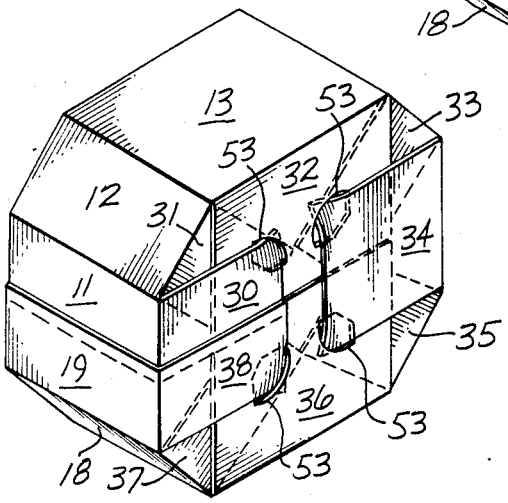
Fig. 5

OCTAGONAL BULK BIN

This application is a continuation of application Ser. No. 485,514, filed 1-17-83, now abandoned, which is a continuation of Ser. No. 255,583, filed 4-20-81, now abandoned.

FIELD OF THE INVENTION

A tubular container with a closure means.

OTHER PATENTS IN THE FIELD

Dempster U.S. Pat. No. 4,119,266 granted Oct. 10, 1978 discloses an octagonal tubular container with a closing means. In this container, the side closure flaps have aligned slots through which the end closure flaps extend. The corner flaps are within the container.

Layne U.S. Pat. No. 3,527,399 granted Sept. 8, 1970 is directed to a rectangular book shipping in which the side closure flaps have finger access apertures.

SUMMARY OF THE INVENTION

A typical octagonal bulk bin is 47 inches wide and 40 inches deep. It is used for packing fresh meat and will hold between 1500 and 2300 pounds of meat. Although the container is normally carried on a pallet, it is still necessary to hold the bottom closure flaps in place during transportation and storage.

The purpose of the present octagonal container closure is to hold the bottom closure flaps in place while maintaining the structural integrity of the flaps by using locking apertures in opposed side closure flaps which remove as little material as possible from the side closure flaps and maintain the rectangular shape of the flaps. The apertures are shaped and located to allow the corners of the opposed end closure flaps to protrude through the apertures and to lock behind the side closure flaps. The shape of the apertures provides a two-way lock on each corner of an end closure flap, holding it both in the length and width direction. This provides a firmer closure that has been previously achieved.

BRIEF DESCRIPTION OF THE DRAWINGS

FIGS. 3–5 are isometric views showing the container closure being formed.

DESCRIPTION OF THE PREFERRED EMBODIMENT

Figure 1:
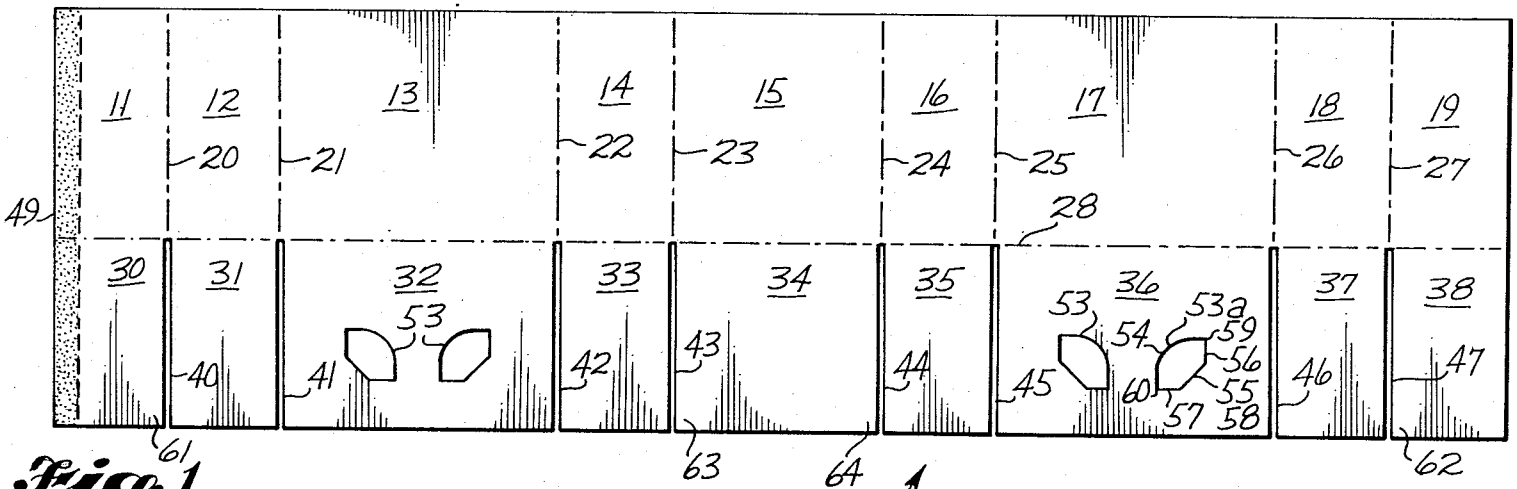
FIG. 1 is a top plan view of the blank for the container.

Blank 10 is divided into a first partial end panel 11, a first corner panel 12, a first side panel 13, a second corner panel 14, a second end panel 15, a third corner panel 16, a second side panel 17, a fourth corner panel 18 and a second partial end panel 19 by transverse score lines 20, 21, 22, 23, 24, 25, 26 and 27. The corner panels are narrower than the side and end panels. A series of closure flaps are connected to these panels along longitudinal scoreline 28 which forms the lower edge of the panels and the hinge between the panels and closure flaps. The first partial end closure flap 30 is attached to the first partial end panel 11; the first corner closure flap 31 is attached to the first corner panel 12; the first side closure flap 22 is attached to the side flap 13; the second corner closure flap 33 is attached to the second corner panel 14; the second end closure flap 34 is attached to the second end panel 15; the third corner closure flap 35 is attached to the third corner panel 16; the second side closure flap 36 is attached to the second side panel 17; the fourth corner closure flap 37 is attached to the fourth corner panel 18; and the second partial end closure flap 38 is attached to the second partial end panel 19. The panels and flaps are substantially rectangular.

The closure flaps are separated by slots which are aligned with the transverse scorelines. The slots 40, 41, 42, 43, 44, 45, 46 and 47 are aligned respectively, with scorelines 20, 21, 22, 23, 24, 25, 26, and 27.

Figure 2:
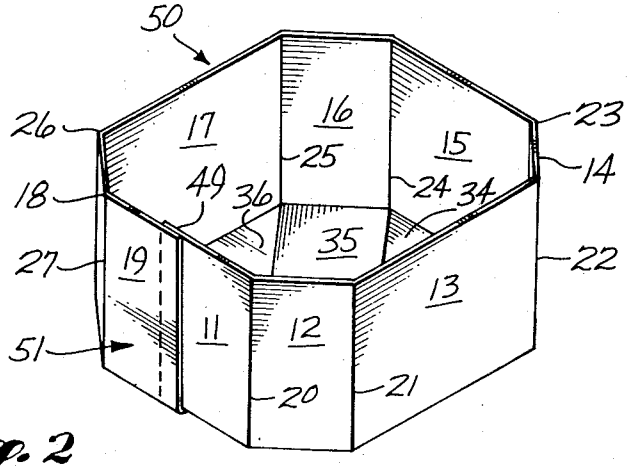
FIG. 2 is an isometric view of the formed container.

In the completed tubular container 50, shown in FIG. 2, the first partial end panel 11 and the second partial end panel 19 are adhered along manufacturers' joint 49 to form the first end panel 51 and the first partial end closure flap 30 and the second partial end closure flap 38 are adhered along manufacturers' joint 49 to form the first end closure flap 52.

The side closure flaps 32 and 36 each have a pair of apertures 53. Each of the apertures is formed by an arcuate inner edge 54, a diagonal outer edge 55 opposite the arcuate edge 54 and side edges 56 and 57, 57 being parallel to the side edges of the flap and 57 being parallel to the upper and lower edges of the flap. The apertures are oriented diagonally across the outer corner of the flap adjacent the aperture. For example, in aperture 53*a*, the edge 55 extends diagonally across the adjacent outer corner 58 of flap 36, and the ends 59 and 60 of arcuate edge 54 are on diagonal line that extends across outer corner 58.

Figure 6:
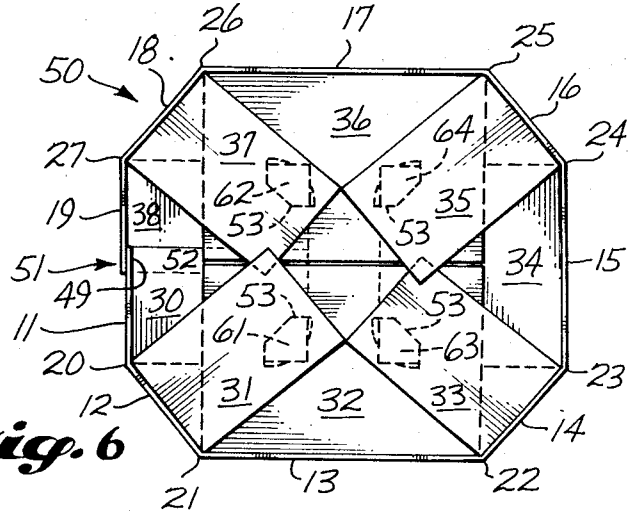
FIG. 6 is a top plan view of the container closure.

The apertures are also located so that the corners of the end flaps will extend through the apertures in the closed container and the corner of the end flap will fit behind the side flap the arcuate edge as shown in FIG. 6.

In forming the container the corner closure flaps 31, 33, 35, and 37 are bent inwardly around scoreline 28 until the flaps are aligned with the scoreline in the interior of the container. The side closure flaps 32 and 36 are then bent inwardly around scoreline 28 until they are aligned with the scoreline. The end closure flaps 52 and 34 are then bent inwardly around scoreline 28 and the corners 61 and 62 of the first end closure flap 52, and 63 and 64 of second end closure flap 34 are inserted through the apertures 53 and locked behind the side panels 32 and 36. As can be seen in FIG. 6, the shape of the apertures locks the end closure flaps in position.

Figure 7:
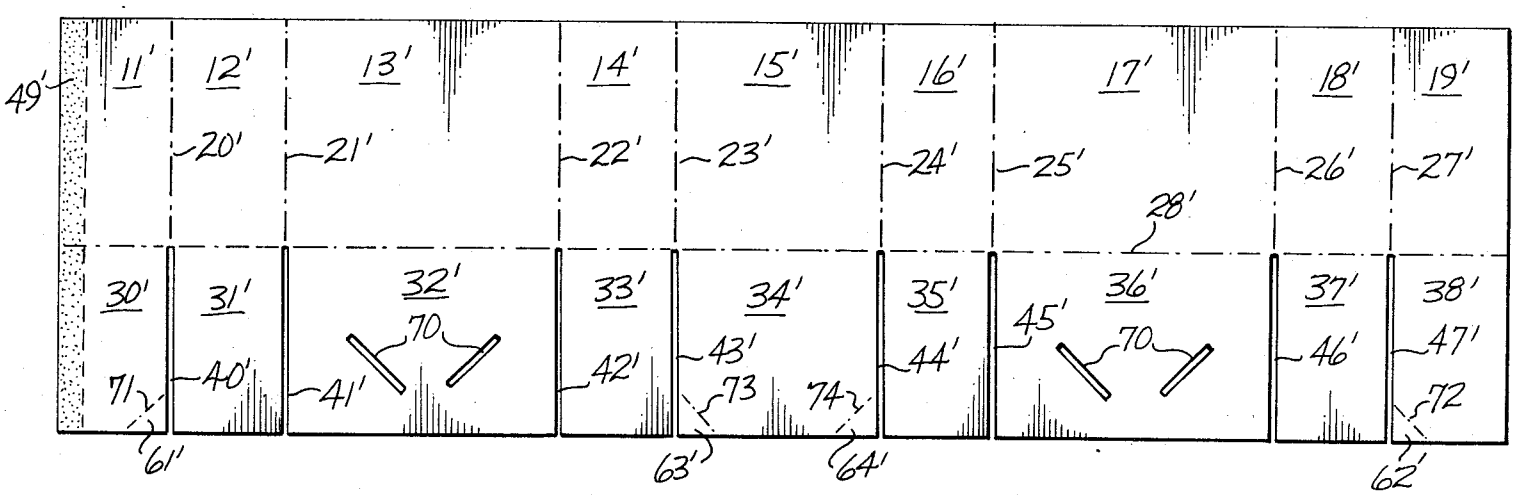

FIG. 7 shows a blank for a different form of the closure. The reference numerals are the same as those in FIG. 1. The principal difference is that apertures 70 are diagonal slots in the side flaps. The slots 70 extend at an acute angle with respect to the outer edge of the side flap and the outer corner adjacent the slot. The corners 61', 62', 63' and 64' are formed by diagonal score lines 71, 72, 73 and 74 respectively. In this container, the corners are folded around the scorelines and placed through the diagonal apertures 70 and locked behind the side flaps.

I claim:

1. An octagonal bulk bin comprising a pair of opposed side panels;

a pair of opposed end panels;

pairs of opposed corner panels extending between said side and end panels, said corner panels being narrower than said side and end panels;

said side, end and corner panels having a common bottom edge and common top edge;

said side, end and corner panels being substantially rectangular;

said side, end and corner panels defining a space having sides defined by said side, end and corner panels, a top defined by said top edge and a bottom defined by said bottom edge;

said bottom being closed by a bottom closure;

said bottom closure comprising corner closure flaps having an edge hinged to said bottom edges of said corner panels and a free inner edge opposite its hinged edge;

said corner closure flaps extending across said bottom and being substantially aligned with said bottom edge;

each of said corner closure flaps being substantially rectangular;

side closure flaps having an edge hinged to said bottom edge of said side panels and a free inner edge opposite its hinged edge;

the distance between said hinged edge and said free inner edge being one-half the distance between said side panels;

the distance between said hinged edge and said free inner edge of each said side closure flap being equal to the distance between said hinged edge and free inner edge of each said corner closure flap;

each of said side closure flaps having a pair of obliquely oriented apertures;

each of said apertures extending across a side closure flap free corner defined by said free inner edge of said side closure flap and a side edge of said side closure flap and between two points located within said side closure flap; the first of said points being near a side edge of said side closure flap and nearer said hinged edge of said side closure flap than said second point; and the second of said points being nearer said side closure flap center line transverse to said hinged edge than said first point and nearer said free inner edge of said side closure flap than said first point;

the placement of said apertures in one side closure flap being identical to the placement of said apertures in the other side closure flap;

each aperture in a side closure flap being a mirror image of the other aperture in the same side closure flap;

said side closure flaps extending across said bottom along the outer faces of said corner closure flaps;

said apertures being spaced from said side panel to which said side closure flap is hinged;

end closure flaps having an edge hinged to said bottom edge of said end panels and a free inner edge opposite its hinged edge;

the maximum distance between said hinged edge and said free inner edge of each said end closure flap being less than one-half the distance between said end panels;

each of said end closure flaps being substantially rectangular;

the distance between said hinged edge and said free inner edge of each of said end closure flaps being equal to the distance between said hinged edged and said free inner edge of each of said corner closure flaps;

each of said end closure flaps extending across said bottom along the outer faces of said side and corner closure flaps, through said oblique apertures and having its free corners extending along the inner face of said side closure flaps;

said end closure flaps being held from length and width movement by the two-way lock on each of said end closure flap by said apertures.

2. The closure of claim 1 in which said apertures have arcuate inner edges, a pair of side edges substantially parallel to the adjacent edge of said side closure flap and an outer edge extending obliquely across the adjacent corner of said side closure flap.

3. An octagonal bulk bin comprising a pair of opposed side panels;

a pair of opposed end panels;

pairs of opposed corner panels extending between said side and end panels, said corner panels being narrower than said side and end panels;

said side, end and corner panels having a common bottom edge and common top edge;

said side, end and corner panels being substantially rectangular;

said side, end and corner panels defining a space having sides defined by said side, end and corner panels, a top defined by said top edge and a bottom defined by said bottom edge;

said bottom being closed by a bottom closure;

said bottom closure comprising corner closure flaps having an edge hinged to said bottom edges of said corner panels and a free inner edge opposite its hinged edge;

said corner closure flaps extending across said bottom and being substantially aligned with said bottom edge;

each of said corner closure flaps being substantially rectangular;

side closure flaps having an edge hinged to said bottom edge of said side panels and a free inner edge opposite its hinged edge;

the distance between said hinged edge and said free inner edge being one-half the distance between said side panels;

the distance between said hinged edge and said free inner edge of each said side closure flap being equal to the distance between said hinged edge and free inner edge of each said corner closure flap;

each of said side closure flaps being substantially rectangular;

each of said side closure flaps having a pair of obliquely oriented slots;

each of said slots extending across a side closure flap free corner defined by said free inner edge of said side closure flap and a side edge of said side closure flap and between two points located within said side closure flap; the first of said points being near a side edge of said closure flap and nearer said hinged edge of said side closure flap than said second point; and the second of said points being nearer said side closure flap center line transverse to said hinged edge than said first point and nearer said free inner edge of said closure flap than said first point;

the placement of said slots in one side closure flap being identical to the placement of said slots in the other side closure flap;

each slot in a side closure flap being a mirror image of the other slot in the same side closure flap;

said side closure flaps extending across said bottom along the outer faces of said corner closure flaps;

said slots being spaced from said side panel to which said side closure flap is hinged;

end closure flaps having an edge hinged to said bottom edge of said end panels and a free inner edge its hinged edge, the maximum distance between said hinged edge and said free inner edge of said end closure flap being less than one-half the distance between said end panels;

each of said end closure flaps being substantially rectangular;

the distance between said hinged edge and said free inner edge of each of said end closure flaps being equal to the distance between said hinged edge and said free inner edge of each of said corner closure flaps;

each of said end closure flaps extending across said bottom along the outer faces of said side and corner closure flaps, through said oblique slots and having its free corners extending along the inner face of said side closure flaps;

said end closure flaps being held from length and width movement by the two-way lock on each of said end closure flap by said slots.

4. The closure of claim 3 in which said end closure flaps have oblique score lines extending across each outer corner, said score lines being aligned with said diagonal slots.

5. A blank for a bulk container comprising in sequence, a first partial end panel, a first corner panel, a first side panel, a second corner panel, a second end panel, a third corner panel, a second side panel, a fourth corner panel and a second partial end panel;

said panels being hingedly connected by scorelines;

said corner panels being narrower than said side and second end panels;

said side, end and corner panels having a common bottom edge and common top edge;

said side, end and corner panels being substantially rectangular;

closure flaps extending from the lower edges of said panels and being hingedly connected to said panels by a scoreline;

said closure flaps being separated from each other;

said closure flaps comprising a first partial end closure flap connected to said first partial end panel, a first corner closure flap connected to said first corner panel, a first side closure flap connected to said first side panel, a second corner closure flap connected to said second corner panel, a second end closure flap connected to said second end panel, a third corner closure flap connected to said third corner panel, a second side closure flap connected to said second side panel, a fourth corner closure flap connected to said fourth corner panel and a second partial end closure flap connected to said second partial end panel;

each of said closure flaps having an edge hinged to said bottom edge of its said respective panel and a free edge opposite its hinged edge;

the distance between said hinged edge and said free edge of each of said closure flaps being equal;

each of said closure flaps being substantially rectangular;

said end closure flaps having no scoreline therein;

each of said side closure flaps having a pair of obliquely oriented apertures;

each of said apertures extending across a side closure flap free corner defined by said free inner edge of said side closure flap and a side edge of said side closure flap and between two points located within said side closure flap; the first of said points being near a side edge of said corner flap and nearer said hinged edge of said side closure flap than said second point; and the second of said points being nearer said side closure flap center line transverse to said hinged edge than said first point and nearer said first inner edge of said side closure flap than said first point;

the placement of said apertures in one side closure flap being identical to the placement of said apertures in the other side closure flap;

each aperture in a side closure flap being a mirror image of the other aperture in the same side closure flap;

said side and end closure flaps being of a dimension and said apertures being placed to allow the corners of said end closure flaps to extend through said apertures and behind said side closure flaps and said end closure flaps to be held from length and width movement by the two-way lock on each of said end closure flaps by said apertures.

6. The blank of claim 5 in which said apertures have arcuate inner edges, a pair of side edges substantially parallel to the adjacent edge of said side closure flap and an outer edge extending obliquely across the adjacent corner of said side closure flap.

7. A blank for a bulk container comprising in sequence, a first partial end panel, a first corner panel, a first side panel, a second corner panel, a second end panel, a third corner panel, a second side panel, a fourth corner panel and a second partial end panel;

said panels being hingedly connected by scorelines;

said corner panels being narrower than said side and second end panels;

said side end and corner panels having a common bottom edge and common top edge;

said side, end and corner panels being substantially rectangular;

closure flaps extending from the lower edges of said panels and being hingedly connected to said panels by a scoreline;

said closure flaps being separated from each other;

said closure flaps comprising a first partial end closure flap connected to said first partial end panel, a first corner closure flap connected to said first corner panel, a first side closure flap connected to said first side panel, a second corner closure flap connected to said second corner panel, a second end closure flap connected to said second end panel, a third corner closure flap connected to said third corner panel, a second side closure flap connected to said second side panel, a fourth corner closure flap connected to said fourth corner panel and a second partial end closure flap connected to said second partial end panel;

each of said closure flaps having an edge hinged to said bottom edge of its said respective panel and a free edge opposite its hinged edge;

the distance between said hinged edge and said free edge of each of said closure flaps being equal;

each of said closure flaps being substantially rectangular;

each of said side closure flaps having a pair of obliquely oriented slots each of said slots extending across a side closure flap free corner defined by said free inner edge of said side closure flap and a side edge of said side closure flap and between two points located within said side closure flaps; the first of said points being near a side edge of said side closure flap and nearer said hinged edge of said side closure flap than said second point; and the second of said points being nearer said side closure flap center line transverse to said hinged edge than said first point and nearer said free inner edge of said side closure flap than said first point;

said slots being spaced from said panel to which said side closure flap is hinged;

the placement of said slots in one side closure flap being identical to the placement of said slots in the other side closure flap;

each slot in a side closure flap being a mirror image of the other slot in the same side closure flap;

said side and end closure flaps being of a dimension and said slots being placed to allow the corners of said end closure flaps to extend through said slots and behind said side closure flaps and said end closure flaps to beheld from length and width movement by the two-way lock on each of said end closure flap by said slots.

8. The blank of claim 7 in which said end closure flaps have oblique score lines extending across each outer corner, said score lines being placed to be aligned with said oblique slots in the closed container.

* * * * *

UNITED STATES PATENT AND TRADEMARK OFFICE

CERTIFICATE OF CORRECTION

PATENT NO. : 4,614,298

DATED : September 30, 1986

INVENTOR(S) : James H. Cherry

It is certified that error appears in the above—identified patent and that said Letters Patent is hereby corrected as shown below:

In column 1, line 17, "corner flaps" should read --corner closure flaps--;

in column 1, line 19, "shipping in" should read --shipping container in--;

in column 1, line 23, "inches wide" should read --inches long, 39 inches wide--;

in column 2, line 22, "57 being" should read --56 being--;

in column 5, line 4, "inner edge its" should read --inner edge opposite its--;

Signed and Sealed this

Fourteenth Day of April, 1987

*Attest:*

DONALD J. QUIGG

*Attesting Officer*

*Commissioner of Patents and Trademarks*